US011730666B2

(12) United States Patent
Xie et al.

(10) Patent No.: US 11,730,666 B2
(45) Date of Patent: Aug. 22, 2023

(54) MASSAGE APPARATUS AND DATA PROCESSING METHOD

(71) Applicant: BEIJING XIAOMI MOBILE SOFTWARE CO., LTD., Beijing (CN)

(72) Inventors: Yingchun Xie, Beijing (CN); Zheng Xing, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 737 days.

(21) Appl. No.: 16/740,385

(22) Filed: Jan. 10, 2020

(65) Prior Publication Data

US 2021/0121360 A1 Apr. 29, 2021

(30) Foreign Application Priority Data

Oct. 24, 2019 (CN) ..... 201911019085.7

(51) Int. Cl.
*A61H 23/00* (2006.01)

(52) U.S. Cl.
CPC ..... *A61H 23/00* (2013.01); *A61H 2201/5012* (2013.01); *A61H 2201/5097* (2013.01)

(58) Field of Classification Search
CPC ..... A61H 23/00; A61H 23/02; A61H 23/004; A61H 23/006; A61H 23/0218; A61H 23/0254; A61H 2023/002
See application file for complete search history.

(56) References Cited

U.S. PATENT DOCUMENTS

2002/0068887 A1* 6/2002 Kikumoto ..... A61H 15/0078 601/57
2013/0331745 A1 12/2013 Sedic et al.
2015/0305971 A1 10/2015 Davis et al.
2015/0366746 A1* 12/2015 Ashby ..... G16H 40/63 601/49

(Continued)

FOREIGN PATENT DOCUMENTS

CN 106963612 A 7/2017
CN 108095705 A 6/2018

(Continued)

OTHER PUBLICATIONS

First office action of Chinese application No. 201911019085.7 dated Jun. 2, 2021.

(Continued)

*Primary Examiner* — Michael J Tsai
(74) *Attorney, Agent, or Firm* — Syncoda LLC; Feng Ma

(57) ABSTRACT

A massage apparatus includes a housing, a massage head, a wireless communication module, and a processor. The wireless communication module and the processor are located inside the housing. The massage head is located on an outer surface of the housing. The wireless communication module is electrically connected to the processor. The processor is electrically connected to the massage head. The wireless communication module is configured to perform wireless communication with an electronic device. The processor is configured to determine a first working state of the massage head, wherein the first working state is determined by motion data collected by the electronic device. The processor is further configured to control the massage head to vibrate according to the first working state.

17 Claims, 7 Drawing Sheets

(56) References Cited

U.S. PATENT DOCUMENTS

| | | | | |
|---|---|---|---|---|
| 2016/0199249 | A1* | 7/2016 | Dunham | A61H 21/00 601/15 |
| 2020/0261307 | A1* | 8/2020 | Wersland | A61H 1/00 |

FOREIGN PATENT DOCUMENTS

| | | | |
|---|---|---|---|
| CN | 109907965 | A | 6/2019 |
| CN | 110339043 | A | 10/2019 |
| EP | 3235484 | A1 | 10/2017 |
| JP | 3184671 | U | 7/2013 |

OTHER PUBLICATIONS

Extended European search report of counterpart EP application No. 20152828.8 dated Oct. 13, 2020.

* cited by examiner

MASSAGE APPARATUS AND DATA PROCESSING METHOD

CROSS-REFERENCE TO RELATED APPLICATION

This application claims priority to Chinese Patent Application 201911019085.7 filed on Oct. 24, 2019, the disclosure of which is hereby incorporated by reference in its entirety.

BACKGROUND

With the improvement of users' living standards, people pay more and more attention to the health of the body, and may choose a variety of electronic devices to ease the fatigue of the body. A "fascia gun," which is an electronic device for dredging muscles and bones of the body, has become popular.

SUMMARY

The present disclosure relates generally to the field of an electronic technology, and more specifically to a massage apparatus and a data processing method.

According to a first aspect of embodiments of the present disclosure, a massage apparatus is provided. The massage apparatus includes a housing, a massage head, a wireless communication module, and a processor, wherein the wireless communication module and the processor are located inside the housing;

the massage head is located on an outer surface of the housing;

the wireless communication module is electrically connected to the processor, and the processor is electrically connected to the massage head;

the wireless communication module is configured to perform wireless communication with an electronic device;

the processor is configured to determine a first working state of the massage head, wherein the first working state is determined by motion data collected by the electronic device; and the processor is further configured to control the massage head to vibrate according to the first working state.

In some embodiments, the wireless communication module is configured to receive the motion data sent by the electronic device, and send the motion data to the processor; and the processor is configured to acquire the first working state of the massage head according to the motion data, and control the massage head to vibrate according to the first working state.

In some other embodiments, the wireless communication module (3) is further configured to receive user data sent by the electronic device, and send the user data to the processor; and the processor is configured to determine an initial working state according to the user data, and adjust the initial working state according to the motion data to obtain the first working state.

In some other embodiments, the wireless communication module is configured to receive the first working state sent by the electronic device, and send the first working state to the processor, wherein the first working state is acquired by the electronic device according to the motion data; and the processor is configured to receive the first working state, and control the massage head to vibrate according to the first working state.

In some other embodiments, the massage apparatus further including a display screen, wherein the display screen is located on an outer surface of the housing and electrically connected to the processor;

the processor is configured to send the first working state to the display screen; and the display screen is configured to receive the first working state sent by the processor, and display the first working state.

In some other embodiments, the massage apparatus further including a voice playing module, wherein the voice playing module is located inside the housing, and electrically connected to the processor; and the voice playing module is configured to convert the first working state sent by the processor into a voice signal, and play the voice signal.

In some other embodiments, the wireless communication module is at least one of a Bluetooth module, a wireless local area network Wi-Fi module, or a ZigBee module.

In some other embodiments, the massage apparatus further including a gear button, wherein the gear button is located on an outer surface of the housing, and electrically connected to the processor;

the gear button is configured to determine a second working state corresponding to a current gear, and send the second working state to the processor; and the processor is further configured to control the massage head to vibrate according to the second working state.

In some other embodiments, the first working state includes at least one of a working frequency, a working intensity, and a working time.

According to a second aspect of embodiments of the present disclosure, a data processing method is provided, which is applied to a massage apparatus, the massage apparatus including a housing, a massage head, a wireless communication module, and a processor, wherein the wireless communication module and the processor are located inside the housing; the massage head is located on an outer surface of the housing; the wireless communication module is electrically connected to the processor, and the processor is electrically connected to the massage head; the wireless communication module is configured to perform wireless communication with an electronic device;

the method includes:

determining, by the processor, a first working state of the massage head, wherein the first working state is determined by motion data collected by the electronic device; and controlling, by the processor, the massage head to vibrate according to the first working state.

In some embodiments, the method further includes:

receiving, by the wireless communication module, the motion data sent by the electronic device, and sending the motion data to the processor; and the step of determining, by the processor, the first working state of the massage head includes:

acquiring, by the processor, the first working state of the massage head according to the motion data.

In some other embodiments, the method further includes:

receiving, by the wireless communication module, user data sent by the electronic device, and sending the user data to the processor; and the step of determining, by the processor, the first working state of the massage head includes:

determining, by the processor, an initial working state according to the user data, and adjusting the initial working state according to the motion data to obtain the first working state.

In some other embodiments, the method further includes:

receiving, by the wireless communication module, the first working state sent by the electronic device, and sending the first working state to the processor, wherein the first working state is acquired by the electronic device according to the motion data; and the step of determining, by the processor, the first working state of the massage head includes:

receiving, by the processor, the first working state.

In some other embodiments, the massage apparatus includes a display screen, wherein the display screen is located on an outer surface of the housing and electrically connected to the processor; and the method further includes:

sending, by the processor, the first working state to the display screen; and receiving, by the display screen, the first working state sent by the processor, and displaying the first working state.

In some other embodiments, the massage apparatus includes a voice playing module, wherein the voice playing module is located inside the housing, and electrically connected to the processor; and the method further includes:

sending, by the processor, the first working state to the voice playing module; and converting, by the voice playing module, the first working state sent by the processor into a voice signal, and playing the voice signal.

In some other embodiments, the massage apparatus includes a gear button, wherein the gear button is located on an outer surface of the housing and electrically connected to the massage head; and the method further includes:

determining, by the gear button, a second working state corresponding to a current gear, and sending the second working state to the processor; and controlling, by the processor, the massage head to vibrate according to the second working state.

According to a third aspect of embodiments of the present disclosure, a data processing method is provided, which is applied to an electronic device and includes:

acquiring collected motion data;

acquiring a first working state according to the motion data; and sending the first working state to the massage apparatus, wherein the massage apparatus includes a housing, a massage head, a wireless communication module, and a processor, wherein the wireless communication module and the processor are located inside the housing; the massage head is located on an outer surface of the housing; the wireless communication module is electrically connected to the processor, and the processor is electrically connected to the massage head; the wireless communication module is configured to receive the first working state; and the processor is configured to control the massage head to vibrate according to the first working state.

According to a fourth aspect of embodiments of the present disclosure, there is provided a non-transitory computer-readable storage medium, wherein the computer-readable storage medium stores at least one instruction, at least one program, a code set or an instruction set, the at least one instruction, the at least one program, the code set or the instruction set being loaded and executed by the processor to perform the data processing method as defined in the third aspect.

In some embodiments, the step of acquiring the first working state according to the motion data includes:

acquiring stored user data;

determining an initial working state of the massage apparatus according to the user data; and adjusting the initial working state according to the motion data to obtain the first working state.

It is to be understood that the above general descriptions and detailed descriptions below are only exemplary and explanatory and not intended to limit the present disclosure.

BRIEF DESCRIPTION OF THE DRAWINGS

The accompanying drawings, which are incorporated in and constitute a part of this disclosure, illustrate embodiments consistent with the present disclosure and, together with the description, serve to explain the principles of the present disclosure.

In drawings, symbols of various parts are described as follows:

1—housing; 2—massage head; 3—wireless communication module; 4—processor; 5—display screen; 6—voice playing module; 7—gear button; 11—main body; and 12—handle.

DETAILED DESCRIPTION

Various embodiments of the present disclosure will be described in further detail with reference to the accompanying drawings, to present the objects, technical solutions, and advantages of the embodiments more clearly.

A massage apparatus such as a fascia gun can include a housing, a massage head, and a gear button, wherein the massage head and the gear button are both mounted on an outer surface of the housing. In the case of using the fascia gun, the user needs to select a strength suitable for himself by adjusting the gear button before using the fascia gun. Since the fascia gun needs to be repeatedly adjusted by the user to meet user needs, the operations are cumbersome and inefficient.

In the following, a fascia gun is used as an example of a massage apparatus to describe various embodiments of the disclosure, although various embodiments disclosed herein can be applied to massage apparatuses other than a fascia gun.

Figure 1:
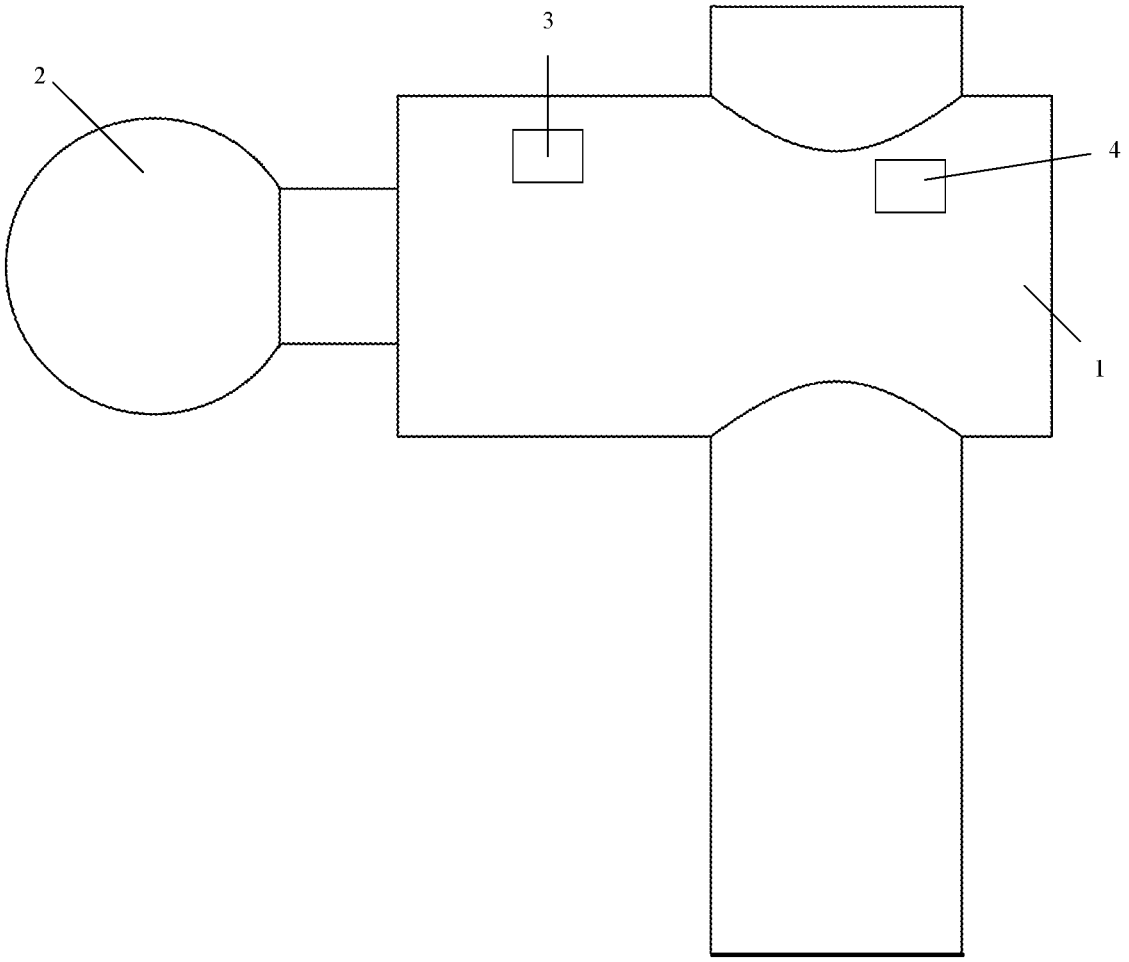
FIG. 1 is a schematic structural diagram of a massage apparatus shown according to an exemplary embodiment.

FIG. 1 is a schematic structural diagram of a fascia gun shown according to an exemplary embodiment. Referring to FIG. 1, the fascia gun includes a housing 1, a massage head 2, a wireless communication module 3, and a processor 4.

The fascia gun can vibrate in a certain working state. When the user uses the fascia gun to vibrate at a body part, the body part can be relaxed.

The housing 1 is a casing of the fascia gun and is configured to accommodate components in the fascia gun. The wireless communication module 3 and the processor 4 are located inside the housing 1, and the massage head 2 is located on an outer surface of the housing 1. In addition, the wireless communication module 3 is electrically connected to the processor 4, and the processor 4 is electrically connected to the massage head 2.

In some embodiments, the housing 1 may be a metal housing, a plastic housing, or a housing of other type.

Figure 2:
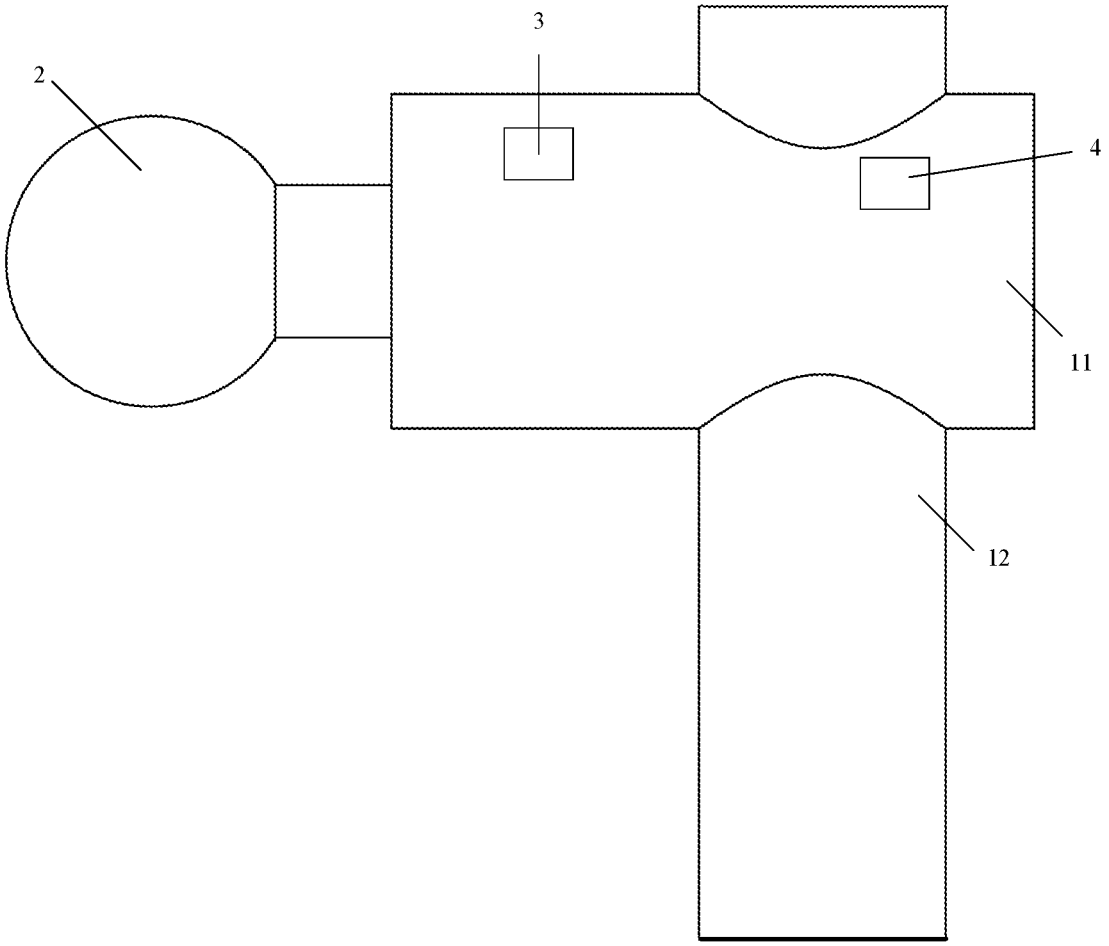
FIG. 2 is a schematic structural diagram of another massage apparatus shown according to an exemplary embodiment.

In some other embodiments, referring to FIG. 2, the housing 1 includes a main body 11 and a handle 12, wherein the main body 11 is connected to the handle 12.

In some embodiments, the main body 11 may be movably connected to the handle 12. In the case that the fascia gun is not used, the handle 12 is folded so as to be attached to the main body 11, thereby the occupied volume of the fascia gun.

The wireless communication module 3 is configured to perform wireless communication with an electronic device. The electronic device and the wireless communication module 3 perform data transmission in a wireless communication manner. The electronic device can be a mobile phone, a tablet computer, a personal computer, or the like.

In some embodiments, the wireless communication module 3 may be at least one of a Bluetooth module, a Wi-Fi (wireless local area network) module, or a ZigBee module.

In the case of the Bluetooth module, the wireless communication module 3 establishes a Bluetooth connection with the electronic device. In the case of the Wi-Fi module, the wireless communication module 3 establishes a wireless local area network connection with the electronic device. In the case of the ZigBee module, the wireless communication module 3 establishes a zigbee connection with the electronic device.

The processor 4 controls the massage head 2 to vibrate according to a first working state, wherein the first working state is determined by motion data collected by the electronic device.

The wireless communication module 3 performs wireless communication with the electronic device. Therefore, the electronic device may send data to the wireless communication module 3. The wireless communication module 3 receives the data sent by the electronic device, and then sends the data to the processor 4. The processor 4 determines the first working state of the massage head 2 according to the data, and then controls the massage head 2 to vibrate according to the first working state.

According to the fascia gun provided by the embodiment of the present disclosure, the wireless communication module 3 performs wireless communication with the electronic device. Therefore, the wireless communication module 3 may receive data sent by the electronic device. The processor 4 acquires the first working state of the massage head 2 according to the data sent by the electronic device, and controls the massage head 2 to vibrate according to the first working state. Therefore, there is no need for a user to manually adjust the working state of the massage head, thereby improving the intelligence of the fascia gun, simplifying the operation, and improving the efficiency.

Figure 3:
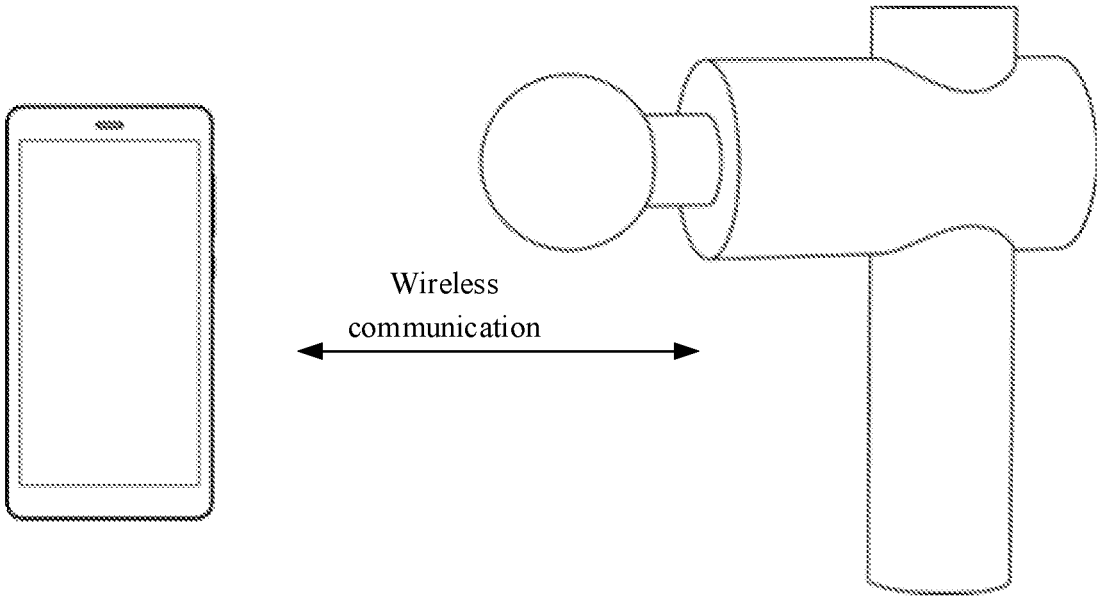
FIG. 3 is a schematic diagram in which an electronic device performs wireless communication with a massage apparatus as shown according to an exemplary embodiment.

In some embodiments, referring to FIG. 3, the electronic device collects motion data of the user, and sends the motion data to the wireless communication module 3. After receiving the motion data, the wireless communication module 3 sends the motion data to the processor 4. The processor 4 may acquire the first working state of the massage head 2 according to the motion data, and control the massage head 2 to vibrate according to the first working state.

The motion data includes the amount of motions performed by the user. For example, the motion data may include the number of push-ups, the number of sit-ups, and the like performed by the user.

The first working state includes at least one of a working frequency, a working intensity, and a working time. The working frequency is used to indicate a vibration frequency of the massage head 2. The working intensity is used to indicate a vibration strength of the massage head 2. The working time is used to indicate a duration of each operation of the massage head 2.

In addition, an application which may collect motion data when the user takes exercises is installed in the electronic device. In need of taking exercises, the user opens the application to select a corresponding exercise option, and then takes exercises according to the application. In addition, the electronic device records the user's motion data through the application during the exercise of the user. Therefore, the electronic device may send the motion data to the wireless communication module 3 in the fascia gun.

In some other embodiments, after receiving the motion data, the processor 4 acquires a working state corresponding to the motion data according to a first preset correspondence relationship, and takes the determined working state as the first working state of the massage head 2.

The first preset correspondence relationship includes a correspondence relationship between the motion data and the working state. The first preset correspondence relationship is stored by the processor, or by a server. The processor acquires the first preset correspondence relationship from the server, and then determines the first working state corresponding to the motion data according to the first preset correspondence relationship.

For example, when the motion data is the number of push-ups and the working state includes the working frequency and the working time, the first preset correspondence relationship is shown in Table 1:

TABLE 1

| | Number of push-ups (times) | Working frequency (times/minute) | Working time (minutes) |
|---|---|---|---|
| 1 | 50 | 2000 | 10 |
| 2 | 100 | 2500 | 15 |
| 3 | 150 | 3000 | 20 |

When the number of push-ups performed by the user is 100 times, the working frequency determined according to the first preset correspondence relationship is 2500 times/minute, and the determined working time is 15 minutes.

In some other embodiments, user data is stored in the electronic device. The electronic device sends the user data to the wireless communication module 3. After receiving the user data, the wireless communication module 3 sends the user data to the processor 4. The processor 4 may determine an initial working state according to the user data, and then adjust the initial working state according to the received motion data to obtain the first working state.

The user data is used to indicate user information. For example, the user data may include the user's gender, age, height, weight, body fat, and the like.

In some embodiments, after receiving the user data, the processor 4 determines an initial working state corresponding to the user data according to a second preset correspondence relationship, then determines an adjustment amplitude corresponding to the motion data according to a third preset correspondence relationship, and adjusts the initial working state according to the adjustment amplitude to obtain the first working state.

The second preset correspondence relationship includes a correspondence relationship between the user data and the initial working state. The third preset correspondence relationship includes a correspondence relationship between the motion data and the adjustment amplitude. The second preset correspondence relationship and the third preset correspondence relationship may be stored by the processor 4, or by a server. The processor 4 acquires the second preset correspondence relationship and the third preset correspondence relationship from the server, and then determines the first working state according to the second preset correspondence relationship and the third preset correspondence relationship.

For example, when the user data is the user's gender, the motion data is the number of push-ups performed by the user, and the initial working state is the working frequency and the working time, the second preset correspondence relationship is shown in Table 2, and the third preset correspondence relationship is shown in Table 3:

TABLE 2

| | Gender | Working frequency (times/minute) | Working time (minutes) |
|---|---|---|---|
| 1 | Female | 1500 | 8 |
| 2 | Male | 2000 | 12 |

TABLE 3

| | Number of push-ups (times) | Working frequency adjustment amplitude (times/minute) | Working time adjustment amplitude (minutes) |
|---|---|---|---|
| 1 | 50 | 200 | 2 |
| 2 | 100 | 300 | 3 |
| 3 | 150 | 400 | 4 |

When the user's gender is male, the working frequency of the determined initial working state is 2000 times/minute, and the working time is 12 minutes. When the user does push-ups for 100 times, it is determined that the adjustment amplitude of the working frequency is 300 times/minute, and the adjustment amplitude of the working time is 3 minutes. The working frequency of the first working state is finally determined as 2300 times/minute, and the working time as 15 minutes.

In some other embodiments, the first working state is acquired by the electronic device according to the motion data. The electronic device sends the acquired first working state to the wireless communication module 3. The wireless communication module 3 receives the first working state sent by the electronic device, and then sends the first working state to the processor 4. After receiving the first working state, the processor 4 controls the massage head 2 to vibrate according to the first working state.

In some other embodiments, the user data is further stored in the electronic device. The electronic device may determine the first working state according to the user data and the motion data, and then send the determined first working state to the wireless communication module 3. The wireless communication module 3 receives the first working state sent by the electronic device, and sends the first working state to the processor 4. After receiving the first working state, the processor 4 controls the massage head 2 to vibrate according to the first working state.

The process of acquiring the first working state by the electronic device according to the motion data is similar to the process of acquiring the first working state by the processor according to the motion data, and will not be described herein again. In addition, the process of acquiring the first working state by the electronic device according to the user data and the motion data is similar to the process of acquiring the first working state by the processor according to the user data and the motion data, and will not be described herein.

It should be noted that the embodiment of the present disclosure is described by using the process of acquiring the first working state according to the motion data as an example. In another embodiment, the type of the massage head 2 may be further acquired according to the motion data, and the user is prompted to replace the massage head 2 with a massage head 2 corresponding to the acquired type of the massage head 2.

After the type of the massage head 2 is acquired, the user can replace the initial massage head 2 of the fascia gun with the massage head 2 corresponding to the type according to the acquired type of the massage head 2. The processor 4 of the fascia gun then controls the newly replaced massage head 2 to work.

In some embodiments, a user's motion type is carried in the motion data. The electronic device sends the motion data to the wireless communication module 3. The wireless communication module 3 receives the motion data, and sends the motion data to the processor 4. After receiving the motion data, the processor 4 determines the type of the massage head 2 corresponding to the motion type in the motion data according to a fourth preset correspondence relationship.

The fourth preset correspondence relationship includes a correspondence relationship between the motion type and the type of the massage head 2. The fourth preset correspondence relationship is stored by the processor 4, or by a server. The processor 4 acquires the fourth preset correspondence relationship from the server, and then determines the type of the massage head 2 corresponding to the motion type according to the fourth preset correspondence relationship.

For example, the fourth preset correspondence relationship is shown in Table 4:

TABLE 4

| | Motion type | Type of the massage type |
|---|---|---|
| 1 | Shoulder exercise | Cylindrical massage head |
| 2 | Joint exercise | Conical massage head |
| 3 | Leg exercise | Ball type massage head |

In some other embodiments, a user's motion type is carried in the motion data. The electronic device determines the type of the massage head 2 corresponding to the motion type in the motion data according to the fourth preset correspondence relationship. The type of the massage head 2 is displayed by the electronic device, or is sent to the wireless communication module 3.

The fourth preset correspondence relationship is stored by the electronic device, or by the server. The electronic device acquires a fifth preset correspondence relationship from the server, and then determines the type of the massage head 2 corresponding to the motion type according to the fifth preset correspondence relationship.

According to the embodiment of the present disclosure, the type of the massage head may be acquired according to the motion data. The user may then replace the initial massage head of the fascia gun with a massage head corresponding to the type, thereby ensuring that the newly replaced massage head matches the user's part to be exercised, and improving the massage effect of the fascia gun.

Figure 4:
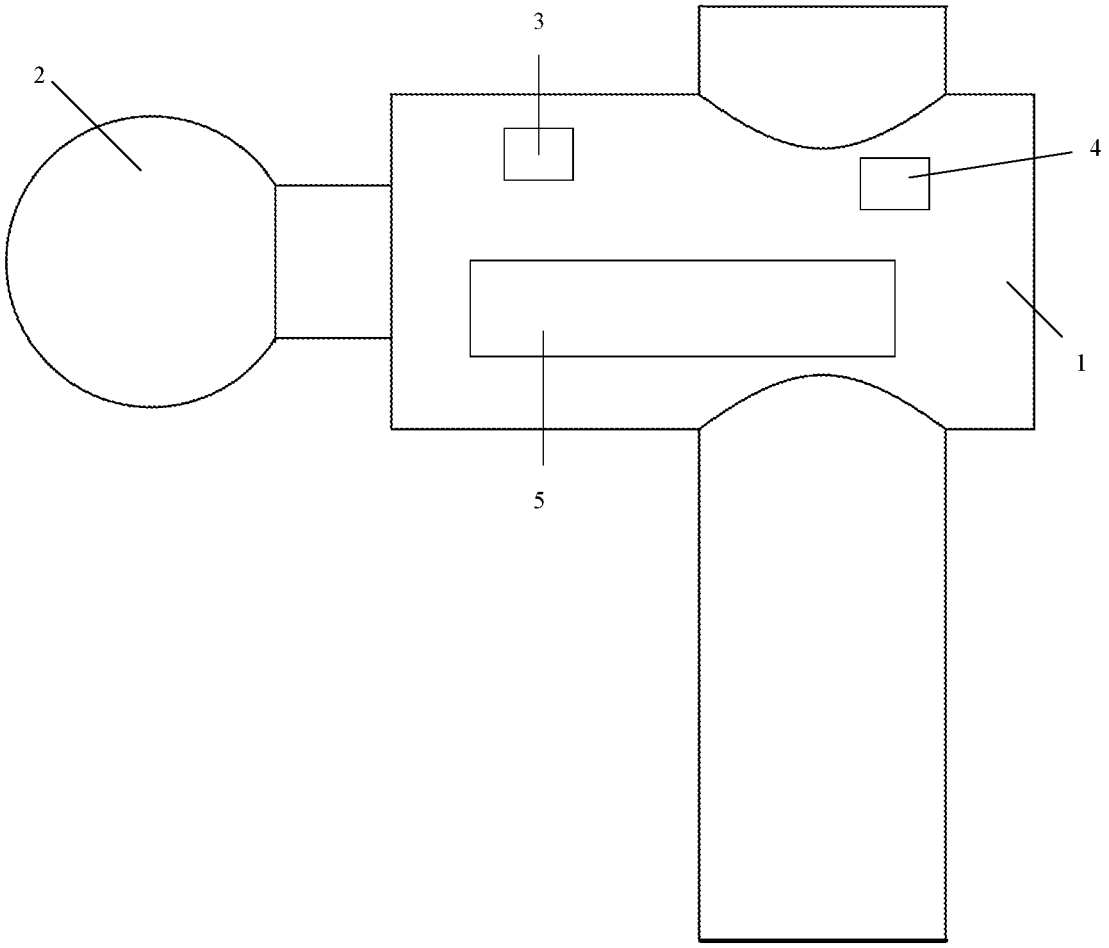
FIG. 4 is a schematic structural diagram of a further massage apparatus shown according to an exemplary embodiment.

In some other embodiments, referring to FIG. 4, the fascia gun further includes a display screen 5. The display screen 5 is located on an outer surface of the housing 1, and electrically connected to the processor 4.

After acquiring the first working state, the processor 4 sends the first working state to the display screen 5. After receiving the first working state, the display screen 5 displays the first working state. The user may then view the first working state through the display screen 5 to determine whether the first working state meets his/her own needs. If the first working state meets the user's own needs, the user can directly use the fascia gun to relax. Alternatively, if the first working state cannot meet the user's own needs, the user can also manually adjust the first working state and control the fascia gun to vibrate in the adjusted working state.

According to the embodiment of the present disclosure, the first working state may be displayed by the display screen 5 arranged in the fascia gun. Therefore, the user may view the first working state through the display screen 5, and determine whether to allow the fascia gun to work in the first working state according to the first working state displayed in the display screen 5, thereby ensuring that the user can know the working state of the fascia gun in real time, and facilitating the user to adjust the working state of the fascia gun.

Figure 5:
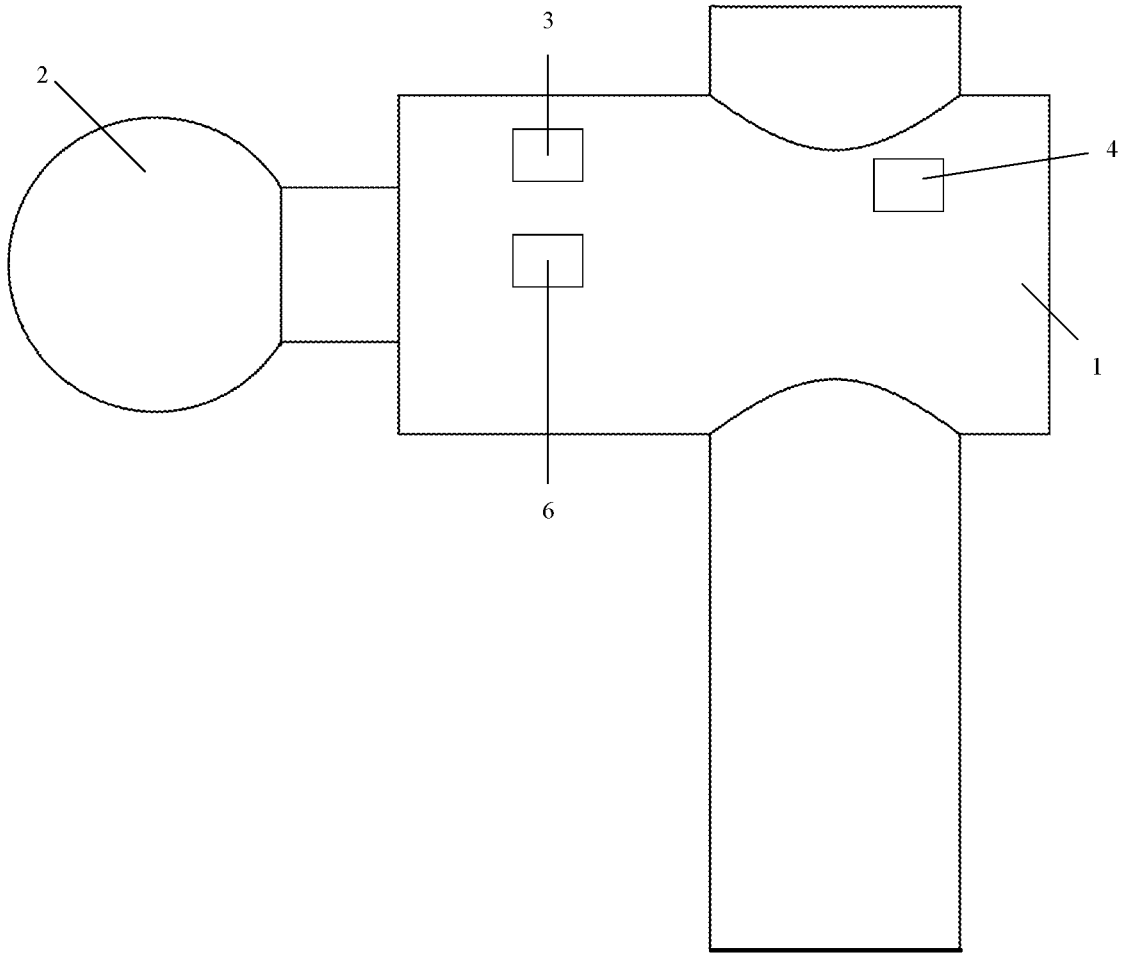
FIG. 5. is a schematic structural diagram of a yet further massage apparatus shown according to an exemplary embodiment.

In some other embodiments, as shown in FIG. 5, the fascia gun further includes a voice playing module 6. The voice playing module 6 is located inside the housing 1, and electrically connected to the processor 4.

After acquiring the first working state, the processor 4 sends the first working state to the voice playing module 6. After receiving the first working state sent by the processor 4, the voice playing module 6 converts the first working state into a voice signal and plays the voice signal. The user may then acquire the currently determined first working state through the voice signal played by the voice playing module 6. The user may further determine whether the first working state meets his/her own needs. If the first working state meets the user's own needs, the user can directly use the fascia gun to relax. Alternatively, if the first working state cannot meet the user's own needs, the user can also manually adjust the first working state and control the fascia gun to vibrate in the adjusted working state.

According to the embodiment of the present disclosure, the voice playing module 6 is arranged in the fascia gun. By means of the voice playing module 6, the first working state sent by the processor 4 may be played out in a form of a voice signal. Therefore, the user may determine the first working state of the fascia gun by means of this voice signal, and further determine whether to allow the fascia gun to work in the first working state according to the first working state, thereby ensuring that the user can know the working state of the fascia gun in real time, and facilitating the user to adjust the working state of the fascia gun.

In addition, the user can determine the first working state through the voice signal played by the voice playing module 6, thereby improving the convenience for the user to learn the first working state.

Figure 6:
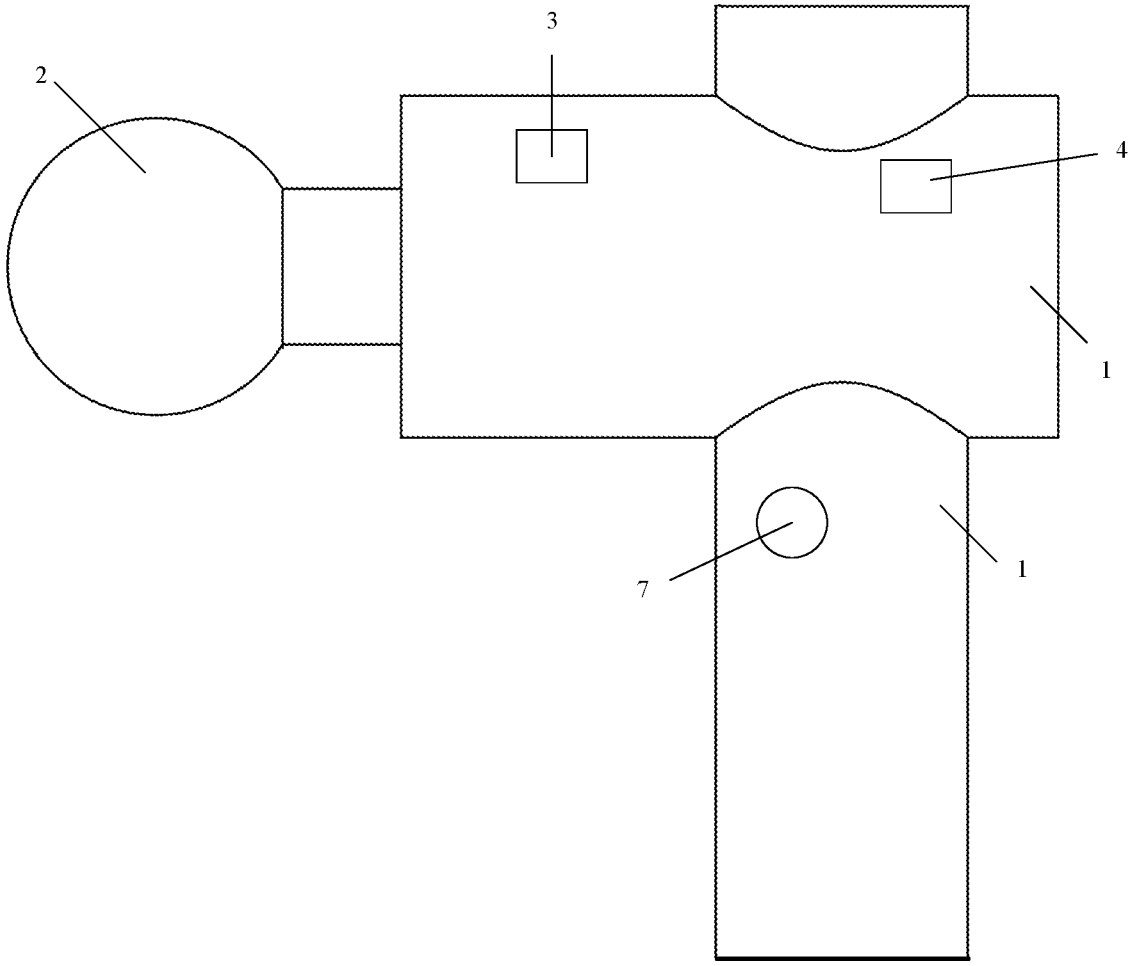
FIG. 6 is a schematic structural diagram of a still further massage apparatus shown according to an exemplary embodiment.

In some other embodiments, referring to FIG. 6, the fascia gun further includes a gear button 7. The gear button 7 is located on an outer surface of the housing 1, and electrically connected to the processor 4.

The gear button 7 determines a second working state corresponding to a current gear, and sends the second working state to the processor 4. After receiving the second working state, the processor 4 controls the massage head 2 to vibrate according to the second working state.

For example, the gear button 7 is provided with a plurality of gears, each of which corresponds to a working state. Therefore, the second working state corresponding to the gear of the current gear button 7 may be determined by the gear button 7.

In some other embodiments, the gear button 7 further includes a switching gear. The switching gear is configured to control whether the fascia gun adopts the first working state determined by the processor 4 or the second working state determined by the gear button 7.

In some embodiments, the switching gear includes a first gear and a second gear. The first gear is configured to indicate that the fascia gun adopts the first working state determined by the processor 4 and vibrates according to the first working state. The second gear is configured to indicate that the fascia gun adopts the second working state determined by the gear button 7, and vibrates according to the second working state.

According to the embodiment of the present disclosure, the gear button 7 is provided to ensure that the fascia gun supports both the first working state determined according to the motion data of the electronic device and the second working state determined according to the gear button 7, thereby enriching the functions of the fascia gun, ensuring that the user can use various functions in the fascia gun as needed, and improving the flexibility.

In some other embodiments, the fascia gun further includes a switch button and a battery. The switch button is located on an outer surface of the housing 1. The battery is located inside the housing 1 of the fascia gun. The switch button is electrically connected to the battery of the fascia gun.

The battery provides power to devices in the fascia gun. The switching button is configured to control the battery to be turned on to start the fascia gun, or to control the battery to be turned off to stop the fascia gun.

Figure 7:
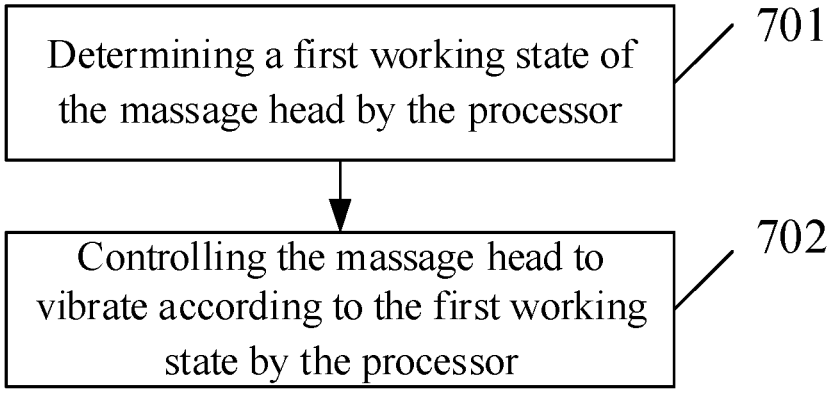
FIG. 7 is a flowchart of a data processing method shown according to an exemplary embodiment.

FIG. 7 is a flowchart of a data processing method shown according to an exemplary embodiment. Referring to FIG. 7, the data processing method is applied to a fascia gun. The fascia gun includes a housing, a massage head, a wireless communication module, and a processor. The wireless communication module and the processor are located inside the housing. The massage head is located on an outer surface of the housing. The wireless communication module is electrically connected to the processor, and the processor is electrically connected to the massage head. The wireless communication module is configured to perform wireless communication with an electronic device. The method includes the following steps.

In step 701, the processor determines a first working state of the massage head.

The first working state is determined by the motion data collected by the electronic device.

In step 702, the processor controls the massage head to vibrate according to the first working state.

In some embodiments, the method further includes:

receiving, by the wireless communication module, the motion data sent by the electronic device, and sending the motion data to the processor.

The determining, by the processor, the first working state of the massage head includes:

acquiring, by the processor, the first working state of the massage head according to the motion data, and controlling the massage head to vibrate according to the first working state.

In some embodiments, the method further includes:

receiving, by the wireless communication module, user data sent by the electronic device, and sending the user data to the processor.

The determining, by the processor, the first working state of the massage head includes:

determining, by the processor, the initial working state according to the user data, and adjusting the initial working state according to the motion data to obtain the first working state.

In some embodiments, the method further includes:

receiving, by the wireless communication module, the first working state sent by the electronic device, and sending the first working state to the processor, wherein the first working state is acquired by the electronic device according to the motion data.

The determining, by the processor, the first working state of the massage head includes:

receiving, by the processor, the first working state.

In some other embodiments, the fascia gun includes a display screen. The display screen is located on an outer surface of the housing, and electrically connected to the processor. The method further includes:

sending, by the processor, the first working state to the display screen; and receiving, by the display screen, the first working state sent by the processor, and displaying the first working state.

In some other embodiments, the fascia gun includes a voice playing module. The voice playing module is located inside the housing, and electrically connected to the processor. The method further includes:

sending, by the processor, the first working state to the voice playing module; and playing, by the voice playing module, the first working state sent by the processor as a voice signal, and playing the voice signal.

In some other embodiments, the fascia gun includes a gear button. The gear button is located on an outer surface of the housing, and electrically connected to the processor. The method further includes:

determining, by the gear button, a second working state corresponding to a current gear, and sending the second working state to the processor; and controlling, by the processor, the massage head to vibrate according to the second working state.

In some other embodiments, the first working state includes at least one of a working frequency, a working intensity, and a working time.

Figure 8:
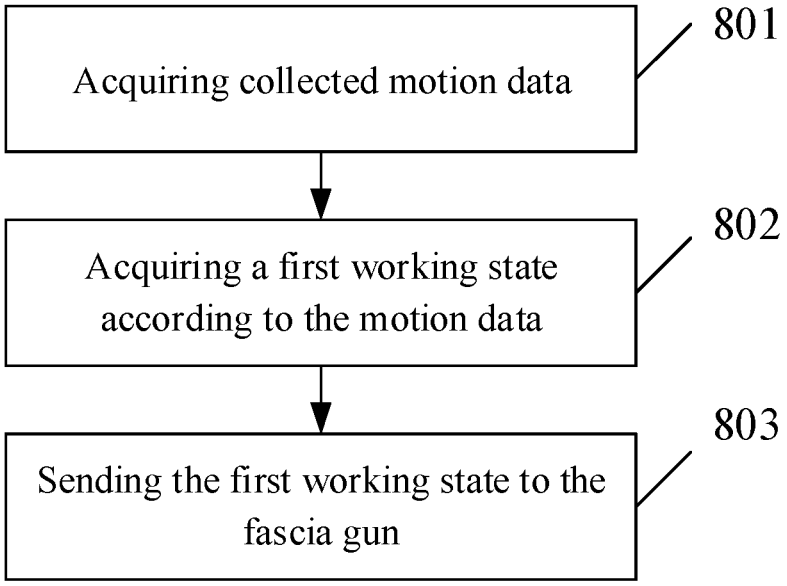
FIG. 8 is a block diagram of a data processing method shown according to an exemplary embodiment.

FIG. 8 is a flowchart of a data processing method shown according to an exemplary embodiment. Referring to FIG. 8, the data processing method is applied to an electronic device and includes the following steps.

In step 801, collected motion data is acquired.

In step 802, a first working state is acquired according to the motion data.

In step 803, the first working state is sent to the fascia gun.

The fascia gun includes a housing, a massage head, a wireless communication module, and a processor. The wireless communication module and the processor are located inside the housing. The massage head is located on an outer surface of the housing. The wireless communication module is electrically connected to the processor, and the processor is electrically connected to the massage head. The wireless communication module is configured to receive the first working state. The processor is configured to control the massage head to vibrate according to the first working state.

In some embodiments, the acquiring the first working state according to the motion data includes:

acquiring stored user data;

determining an initial working state of the fascia gun according to the user data; and adjusting the initial working state according to the motion data to obtain the first working state.

Various embodiments of the present disclosure can have one or more of the following advantages.

According to the fascia gun and the data processing method provided by the embodiments of the present disclosure, since the wireless communication module is configured to perform wireless communication with the electronic device, the wireless communication module may receive data sent by the electronic device, and the processor acquires the first working state of the massage head according to the data sent by the electronic device and controls the massage head to vibrate according to the first working state. Therefore, there is no need for a user to manually adjust the working state of the massage head, thereby improving the intelligence of the fascia gun, simplifying the operation, and improving the efficiency.

The various device components, units, blocks, or portions may have modular configurations, or are composed of discrete components, but nonetheless can be referred to as "modules" in general. In other words, the "components," "modules," "blocks," "portions," or "units" referred to herein may or may not be in modular forms.

Other implementation solutions of the present disclosure will be apparent to those skilled in the art from consideration of the specification and practice of the present disclosure. This disclosure is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In the present disclosure, the terms "installed," "connected," "coupled," "fixed" and the like shall be understood broadly, and may be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

It will be understood that when an element such as a layer, region, or other structure is referred to as being "on" or extending "onto" another element, it can be directly on or extend directly onto the other element or intervening elements can also be present. In contrast, when an element is referred to as being "directly on" or extending "directly onto" another element, there are no intervening elements present.

Likewise, it will be understood that when an element such as a layer, region, or substrate is referred to as being "over" or extending "over" another element, it can be directly over or extend directly over the other element or intervening elements can also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

Relative terms such as "below" or "above" or "upper" or "lower" or "vertical" or "horizontal" can be used herein to describe a relationship of one element, layer, or region to another element, layer, or region as illustrated in the drawings. It will be understood that these terms and those discussed above are intended to encompass different orientations of the device in addition to the orientation depicted in the drawings.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

In some embodiments, the control and/or interface software or app can be provided in a form of a non-transitory computer-readable storage medium having instructions stored thereon. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. A massage apparatus comprising a housing, a massage head, a wireless communication module, and a processor, wherein the wireless communication module and the processor are located inside the housing;

the massage head is located on an outer surface of the housing;

the wireless communication module is electrically connected to the processor, and the processor is electrically connected to the massage head;

the wireless communication module is configured to perform wireless communication with an electronic device, receive motion data sent by the electronic device, and send the motion data to the processor;

the processor is configured to determine a first working state of the massage head according to the motion data, wherein the processor is configured to determine an initial working state corresponding to user data according to a user data correspondence relationship, determine an adjustment amplitude corresponding to the motion data according to a motion data correspondence relationship, and adjust the initial working state according to the adjustment amplitude to obtain the first working state, wherein the second preset correspondence relationship comprises a correspondence relationship between the user data and the initial working state, and the third preset correspondence relationship comprises a correspondence relationship between the motion data and the adjustment amplitude;

the processor is further configured to control the massage head to vibrate according to the first working state; and the processor is further configured to acquire a type of the massage head according to the motion data, and prompt a user to replace the massage head with a second massage head corresponding to the acquired type of the massage head.

2. The massage apparatus according to claim 1, wherein the wireless communication module is further configured to receive the user data sent by the electronic device, and send the user data to the processor.

3. The massage apparatus according to claim 1, wherein the wireless communication module is configured to receive the first working state sent by the electronic device, and send the first working state to the processor, wherein the first working state is acquired by the electronic device according to the motion data; and the processor is configured to receive the first working state, and control the massage head to vibrate according to the first working state.

4. The massage apparatus according to claim 1, further comprising a display screen, wherein the display screen is located on an outer surface of the housing and electrically connected to the processor;

the processor is configured to send the first working state to the display screen; and the display screen is configured to receive the first working state sent by the processor, and display the first working state.

5. The massage apparatus according to claim 1, further comprising a voice playing module, wherein the voice playing module is located inside the housing, and electrically connected to the processor; and the voice playing module is configured to convert the first working state sent by the processor into a voice signal, and play the voice signal.

6. The massage apparatus according to claim 1, wherein the wireless communication module comprises at least one of a Bluetooth module, a wireless local area network Wi-Fi module, or a ZigBee module; and wherein the first working state includes at least one of a working frequency, a working intensity, and a working time.

7. The massage apparatus according to claim 1, further comprising a gear button, wherein the gear button is located on an outer surface of the housing, and electrically connected to the processor;

the gear button is configured to determine a second working state corresponding to a current gear, and send the second working state to the processor; and the processor is further configured to control the massage head to vibrate according to the second working state.

8. The massage apparatus according to claim 1, wherein the massage apparatus comprises a fascia gun;

the wireless communication module is configured to perform wireless communication with the electronic device and receive data sent by the electronic device;

the processor is configured to acquire the first working state of the massage head according to the data sent by the electronic device and control the massage head to vibrate according to the first working state without a user manually adjusting the working state of the massage head.

9. A data processing method, which is applied to a massage apparatus, the massage apparatus comprising a housing, a massage head, a wireless communication module, and a processor, wherein the wireless communication module and the processor are located inside the housing; the massage head is located on an outer surface of the housing; the wireless communication module is electrically connected to the processor, and the processor is electrically connected to the massage head; the wireless communication module is configured to perform wireless communication with an electronic device; and the method comprising:

receiving, by the wireless communication module, motion data sent by the electronic device, and sending the motion data to the processor;

determining, by the processor, a first working state of the massage head according to the motion data, wherein the processor determines an initial working state corresponding to user data according to a user data correspondence relationship, determines an adjustment amplitude corresponding to the motion data according to a motion data correspondence relationship, and adjusts the initial working state according to the adjustment amplitude to obtain the first working state, wherein the second preset correspondence relationship comprises a correspondence relationship between the user data and the initial working state, and the third preset correspondence relationship comprises a correspondence relationship between the motion data and the adjustment amplitude;

controlling, by the processor, the massage head to vibrate according to the first working state; and acquiring, by the processor, a type of the massage head according to the motion data, and prompt a user to replace the massage head with a second massage head corresponding to the acquired type of the massage head.

10. The method according to claim 9, further comprising:

receiving, by the wireless communication module, the user data sent by the electronic device, and sending the user data to the processor.

11. The method according to claim 9, further comprising:

receiving, by the wireless communication module, the first working state sent by the electronic device, and sending the first working state to the processor, wherein the first working state is acquired by the electronic device according to the motion data; and the determining, by the processor, the first working state of the massage head comprises:

receiving, by the processor, the first working state.

12. The method according to claim 9, wherein the massage apparatus comprises a display screen, wherein the display screen is located on an outer surface of the housing and electrically connected to the processor; and the method further comprises:

sending, by the processor, the first working state to the display screen; and receiving, by the display screen, the first working state sent by the processor, and displaying the first working state.

13. The method according to claim 9, wherein the massage apparatus comprises a voice playing module, wherein the voice playing module is located inside the housing, and electrically connected to the processor; and the method further comprises:

sending, by the processor, the first working state to the voice playing module; and converting, by the voice playing module, the first working state sent by the processor into a voice signal, and playing the voice signal.

14. The method according to claim 9, wherein the massage apparatus comprises a gear button, wherein the gear button is located on an outer surface of the housing and electrically connected to the processor; and the method further comprises:

determining, by the gear button, a second working state corresponding to a current gear, and sending the second working state to the processor; and controlling, by the processor, the massage head to vibrate according to the second working state.

15. The massage apparatus according to claim 9, wherein the first working state includes at least one of a working frequency, a working intensity, or a working time.

16. A data processing method, which is applied to an electronic device and comprises:

acquiring collected motion data;

acquiring stored user data, determining an initial working state corresponding to the user data according to a user data correspondence relationship, determining an adjustment amplitude corresponding to the motion data according to a motion data correspondence relationship, and adjusting the initial working state according to the adjustment amplitude to obtain the first working state, wherein the second preset correspondence relationship comprises a correspondence relationship between the user data and the initial working state, and the third preset correspondence relationship comprises a correspondence relationship between the motion data and the adjustment amplitude; and sending the first working state to a massage apparatus, wherein the massage apparatus comprises a housing, a massage head, a wireless communication module, and a processor, wherein the wireless communication module and the processor are located inside the housing; the massage head is located on an outer surface of the housing; the wireless communication module is electrically connected to the processor, and the processor is electrically connected to the massage head; the wireless communication module is configured to receive the first working state; and the processor is configured to control the massage head to vibrate according to the first working state;

wherein the method further comprises:

acquiring a type of the massage head according to the motion data; and displaying the type of the massage head to prompt the user to replace the massage head with a second massage head corresponding to the acquired type of the massage head; or sending the type of the massage head to the wireless communication module, the wireless communication module is configured to receive the type of the massage head and send the type of the massage head to the processor, and the processor is configured to receive the type of the massage head, and prompt a user to replace the massage head with the second massage head corresponding to the acquired type of the massage head.

17. A non-transitory computer-readable storage medium having instructions stored thereon for execution by the processor to perform the data processing method according to claim 9.

* * * * *